US009629203B1

(12) United States Patent
Downs, Jr.

(10) Patent No.: US 9,629,203 B1
(45) Date of Patent: Apr. 18, 2017

(54) RADIANT HEAT BARRIER INSULATION SYSTEM

(71) Applicant: Edward F. Downs, Jr., Lynn Haven, FL (US)

(72) Inventor: Edward F. Downs, Jr., Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 382 days.

(21) Appl. No.: 14/224,928

(22) Filed: Mar. 25, 2014

(51) Int. Cl.
*H05B 3/34* (2006.01)
*H05B 1/02* (2006.01)

(52) U.S. Cl.
CPC ..... *H05B 1/0272* (2013.01)

(58) Field of Classification Search
CPC ..... H05B 1/0272; H05B 3/145; H05B 3/34; H05B 3/342; H05B 3/36; H05B 3/40; H05B 3/345; H05B 3/347; H05B 2214/04; H05B 2203/003; H05B 2203/013; H05B 2203/036
See application file for complete search history.

(56) References Cited

U.S. PATENT DOCUMENTS

2008/0083721 A1* 4/2008 Kaiserman ..... A43B 3/0005 219/211
2010/0126981 A1* 5/2010 Heintz ..... C08F 259/08 219/482

* cited by examiner

*Primary Examiner* — Shawntina Fuqua
(74) *Attorney, Agent, or Firm* — James T. Shepherd

(57) ABSTRACT

A radiant heat barrier insulation system includes a first substrate with a first layer of aluminum thereon. The system also includes a second substrate with a second layer of aluminum thereon. The first substrate is positioned to oppose the second substrate such that a gap is defined between the first substrate and the second substrate. The gap is filled with a randomly-oriented nest of carbon nanotube fibers.

10 Claims, 3 Drawing Sheets

RADIANT HEAT BARRIER INSULATION SYSTEM

ORIGIN OF THE INVENTION

The invention described herein may be manufactured and used by or for the Government of the United States of America for Governmental purposes without payment of any royalties.

FIELD OF THE INVENTION

The invention relates generally to thermal insulation, and more particularly to an insulation system using carbon nanotube fibers nested between two radiant heat barriers.

BACKGROUND OF THE INVENTION

Insulating people and things from cold temperatures involves the use of a wide variety of garments and structures designed to retain heat. For example, existing garments and structures typically use some type of passive insulation such as down feathers, wool, engineered sheets and fabrics, fiberglass insulation, and aerogel, to trap air inside the insulation. In general, the advantages of passive insulation include simplicity, low-cost, and ready availability. However, the primary drawback of using existing passive insulation is that increased insulating properties are only achieved with increased thickness. Unfortunately, thickness restrictions in some garments or structures can limit the effectiveness of passive insulation.

SUMMARY OF THE INVENTION

Accordingly, it is an object of the present invention to provide an insulation system.

Another object of the present invention to provide a thin insulation system that can be implemented in a passive fashion.

Still another object of the present invention is to provide an insulation system that is readily adaptable to provide active heating along with passive insulation properties.

Other objects and advantages of the present invention will become more obvious hereinafter in the specification and drawings.

In accordance with the present invention, a radiant heat barrier insulation system includes a first substrate With a first layer of aluminum on the first substrate. The system also includes a second substrate with a second layer of aluminum on the second substrate. The first substrate is Positioned to oppose the second substrate such that at least one gap is defined between the first substrate and the second substrate. The gap(s) can be filled with air and randomly-oriented, nested carbon nanotubes.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

In general, the present invention is a radiant heat barrier insulation system that retains one's body heat or the heat within a structure by preventing heat loss from the body/structure. The basic principles of heat loss prevention employed by the present invention can be achieved by each of the embodiments that will be described herein. The various embodiments can be constructed to be flexible or rigid insulation systems without departing from the scope of the present invention. Accordingly, the present invention can be utilized in both garments and structures.

Figure 1:
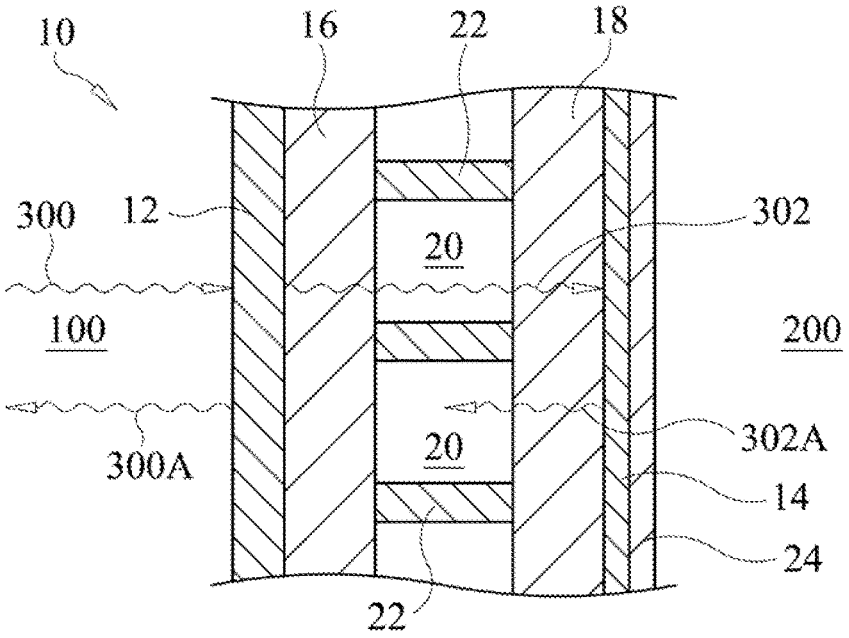
FIG. 1 is a cross-sectional view of a radiant heat barrier insulation system in accordance with an embodiment of the present invention.

Referring now to the drawings and more particularly to FIG. 1, a cross-sectional view of a portion of a radiant heat barrier insulation system in accordance with an embodiment of the present invention is shown and is referenced generally by numeral 10. Insulation system 10 defines a radiant heat barrier that substantially prevents heat loss from a heated region 100 (e.g., a living being, a heated structure, warmer environment, etc.) to a colder region 200 (e.g., an ambient air or water environment).

Insulation system 10 is a layered structure with its outer layers 12 and 14 made of aluminum that can be in sheet form or deposited in place without departing from the scope of the present invention. Layer 12 is disposed adjacent heated region 100 and layer 14 is disposed adjacent colder region 200 (except when covered by insulation layer 24 as discussed below). Layer 12 is also adjacent to and supported on a substrate 16, while layer 14 is adjacent to and supported on a substrate 18. Details regarding substrates 16 and 18 will be provided later below.

Insulation system 10 is constructed such that substrates 16 and 18 oppose one another and are completely or substantially separated from one another to define a central gap or gap regions 20 between substrates 16 and 18. In the illustrated embodiment of system 10, gap regions 20 are filled with air. Spacer(s) 22 can be used to maintain gap regions 20. Spacer(s) 22 can be individual elements or be part of a structure (e.g., a mesh screen, stitching, any non-heat-conducting material, etc.) disposed between substrates 16 and 18. Spacer(s) 22 can also be representative of any medium for coupling substrate 16 to substrate 18 while also defining gap regions 20.

Insulation system 10 prevents heat loss from heated region 100 to colder region 200 via radiant heat principles. Specifically, radiant heat emanating from heated region 100 (referenced by wavy-line arrow 300) is substantially reflected back to heated region 100 by aluminum layer 12 as reflected radiation 300A. However, a portion of radiant heat 300 will pass through aluminum layer 12 and substrate 16 as radiant heat 302. Air-filled gap region(s) 20 slows conduction of heat 302, while aluminum layer 14 reflects heat 302 back towards heated region 100 as reflected radiation 302A. Although not required, it may be desirable for some applications to provide a layer of insulation 24 (e.g., polypropylene, a polypropylene and waterproof laminate, etc.) on the outer face of aluminum layer 14.

The above-described layered structure keeps aluminum layer 12 well insulated from colder region 200. In this way, aluminum layer 12 does not act as a conductor of heat as is the case for aluminum layer 14 that is in contact with colder region 200. However, the amount of radiant heat 302 actually reaching aluminum layer 14 is substantially less than radiant heat 300 reaching aluminum layer 12. Accordingly, conduction of radiant heat 302 by aluminum layer 14 is of minimal consequence since the (heat) energy level associated with radiant heat 302 has been greatly diminished as compared to radiant heat 300.

Substrates 16 and 18 can be rigid or flexible without departing from the scope of the present invention. In terms of flexible substrate materials, substrates 16 and 18 could be realized by hydrophobic fabrics (to keep the user dry) such as polypropylene, or strength-providing materials such as carbon nanotube (CNT) fiber sheets or materials made from CNT/polymer hybrid fibers. For example, if the system was intended to be worn as a dive suit by a diver in an underwater environment, substrate 18 could be comprised of a hydrophobic fabric to keep the diver dry while substrate 16 could be comprised of CNT fiber sheets to add strength to the suit to, e.g., prevent damage or puncture. Alternatively, both substrates 16 and 18 could be comprised of hydrophobic fabrics; or, in a non-diving environment they could both be comprised of CNT fiber sheets or other puncture- or damage-resistant materials.

Figure 2:
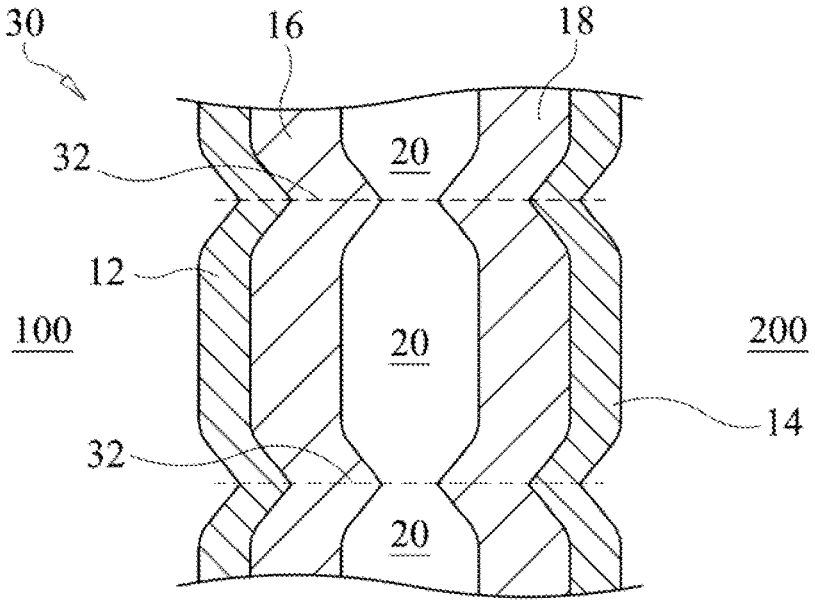
FIG. 2 is a cross-sectional view of a radiant heat barrier insulation system using quilting to define gaps in the central region of the system in accordance with another embodiment of the present invention.

Referring now to FIG. 2, another insulation system 30 in accordance with the present invention designed for flexibility uses stitching (indicated by dashed lines 32) to essentially "quilt" insulation system 30. That is, stitching 32 holds layers 12, 14, 16 and 18 of insulation system 30 together while also defining air-filled gap regions 20 between lines of stitching 32. Methods of stitching to yield such a quilted system are well-known in the art.

Figure 3:
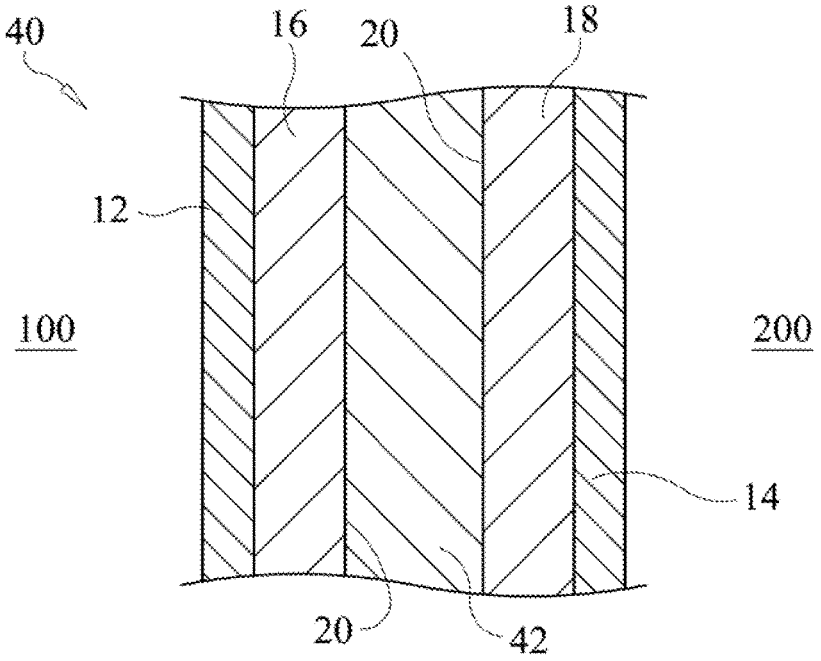
FIG. 3 is a cross-sectional view of a radiant heat barrier insulation system using fabric to define and fill the central region of the system in accordance with another embodiment of the present invention.

Referring now to FIG. 3, an insulation system 40 has its central gap region 20 filled with a material 42 providing additional thermal insulation (e.g., polypropylene) and/or strength or ballistic protection (e.g, KEVLAR). If insulation system 40 is to be employed in underwater diving applications, material 42 can be a non-compressible material defining air-filled regions (e.g., closed cell foams) so that underwater pressures do not cause the air-filled regions to collapse.

Figure 4:
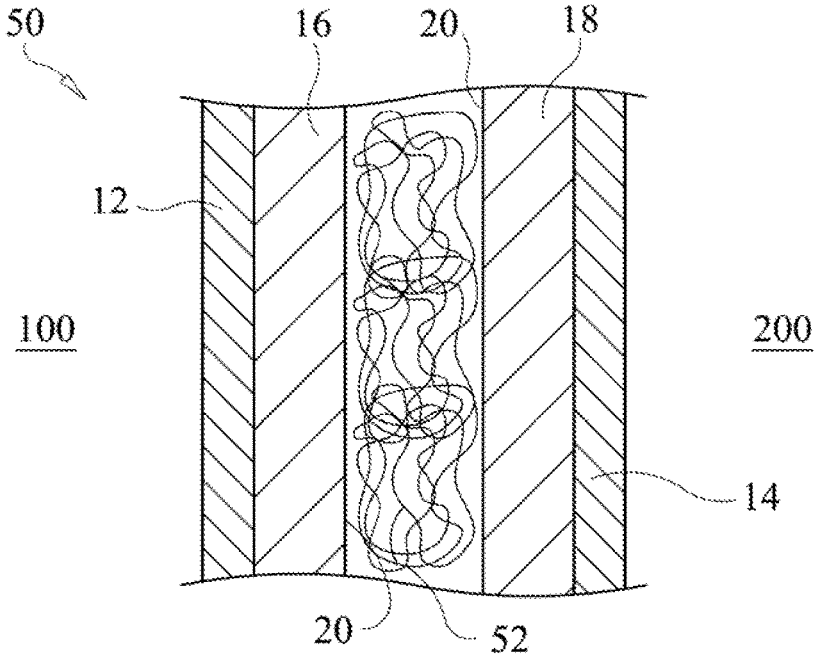
FIG. 4 is a cross-sectional view of a radiant heat barrier insulation system using randomly-oriented carbon nanotubes (CNTs) to define and fill the central region of the system in accordance with another embodiment of the present invention.

Another embodiment of the present invention is illustrated in FIG. 4 where an insulation system 50 fills gap region 20 between substrates 16 and 18 with randomly-oriented CNT fibers 52. The inclusion of CNT fibers 52 serves as a mechanical impediment to the collapse of the gap between substrates 16 and 18, and provides thermal insulation. As is known in the art, a CNT is a rolled-up sheet of graphene that conducts heat rapidly because mechanical vibrations are unimpeded by the nanotube structure. While this property makes a CNT fiber an excellent heat conductor, it was discovered that a randomly-oriented collection of CNT fibers acts as a thermal insulator instead of an efficient heat conductor. Such thermal insulation properties result from the interference between different vibrational modes of the CNT fibers in their random orientations.

Accordingly, the instant invention takes advantage of this unique phenomenon by winding CNT fibers into a series of random overlapping coils known as nested fibers. These nested fibers 52 are inserted into the air-filled gap region 20 between substrates 16 and 18. The nested fibers 52 serve two functions: First, they function as passive insulation preventing the flow of heat energy away from the inner surface 12 toward the outer surface 14. Second, they act as a mechanical support preventing the gap region 20 from collapsing when, e.g., the garment is worn by a scuba diver at depth. Water pressure tries to compress the volume of the gap region 20, but the nested fibers 52 prevent this from occurring. This allows the gap region 20 to maintain its initial physical dimension, and thereby continue to perform as a passive insulator.

Figure 5:
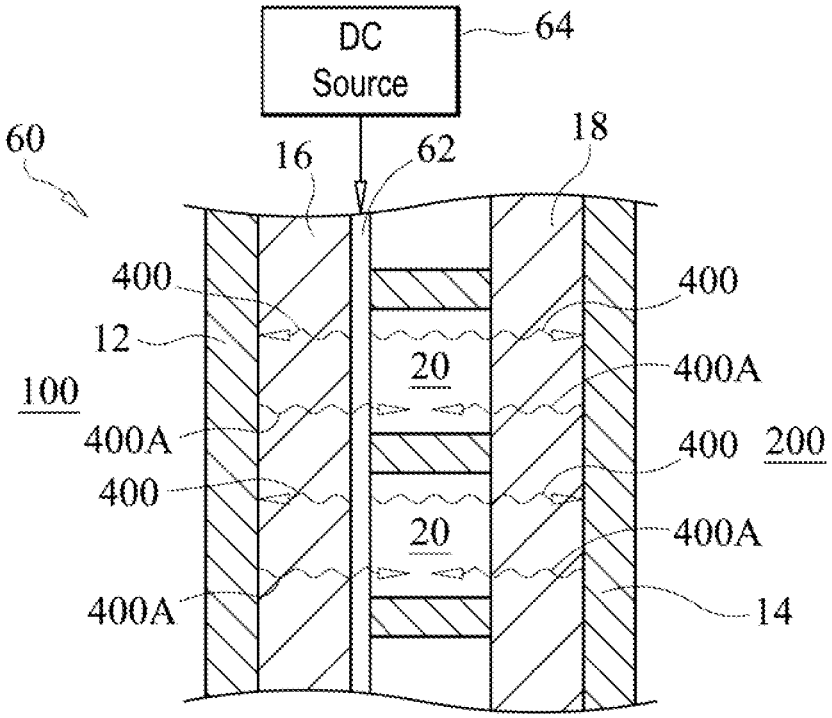
FIG. 5 is a cross-sectional view of a radiant barrier insulation system that further includes CNT fibers coupled to a DC current source for the active introduction of heat into the central region of the system in accordance with another embodiment of the present invention.

The above-described embodiments of the present invention are all passive insulating systems. However, each could also be modified to incorporate active heating in addition to passive insulation. Accordingly, FIG. 5 illustrates another insulation system 60 that is a modification of the above-described insulation system 10. Insulation system 60 includes CNT fibers or CNT/polymer hybrid fibers 62 (only on is shown in FIG. 5) disposed along the surface of substrate 16 adjacent to gap region(s) 20. A DC source 64 is coupled to CNT fiber 62. As is known in the art, CNT fibers can serve as electrical conductors. When DC current flows through a CNT fiber, the fiber behaves like a light emitting diode and emits long wave infrared energy. The emitted energy (referenced by wavy arrows 400) is reflected (referenced by wavy arrows 400A) by each of aluminum layers 12/14 back to gap region(s) 20 thereby further aiding heat retention by heated region 100. Since fiber(s) 62 will never heat to an "untouchable" temperature, the fibers could be provided directly on aluminum layer 12 so that they would be directly adjacent to the skin of the diver in a diving application to provide direct heat to the diver.

The advantages of the present invention are numerous. The use of two separated radiant heat barriers improves heat retention in thin insulation systems. The insulation systems can be made flexible for ready incorporation into a variety of garments for use in cold air or water environments. The insulation systems can also be incorporated in a wide variety of flexible structures (e.g., blankets, tents, etc.) or rigid structures (e.g., food/beverage coolers, aircraft, housing insulation, pipe insulation, etc.). Passive insulation properties can be enhanced by the inclusion of an active heating system for extreme-cold applications.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A radiant heat barrier insulation system, comprising:

a first substrate having an inner and outer side;

a first layer of aluminum on said outer side of said first substrate;

a second substrate having an inner and outer side, said second substrate positioned so that said inner side of said second substrate opposes said inner side of said first substrate, forming a gap therebetween;

a second layer of aluminum on said outer side of said second substrate; and a randomly-oriented nest of carbon nanotube fibers disposed within said gap.

2. A radiant heat barrier insulation system as in claim 1, wherein at least one of said first substrate and said second substrate comprises a hydrophobic fabric.

3. A radiant heat barrier insulation system as in claim 1, wherein at least one of said first substrate and said second substrate comprises a carbon nanotube fabric sheet.

4. A radiant heat barrier insulation system as in claim 1, wherein said first substrate comprises a carbon nanotube fabric sheet and said second substrate comprises a hydrophobic fabric.

5. A radiant heat barrier insulation system as in claim 1, further comprising:

at least one carbon nanotube fiber coupled to one of said first substrate and said second substrate adjacent to said gap; and a DC current source coupled to said at least one carbon nanotube fiber.

6. A radiant heat barrier insulation system as in claim 1, further comprising:

at least one carbon nanotube fiber coupled to one of said first layer of aluminum and said second layer of aluminum; and a DC current source coupled to said at least one carbon nanotube fiber.

7. A radiant heat barrier insulation system as in claim 4, further comprising:

at least one carbon nanotube fiber coupled to said first layer of aluminum; and a DC current source coupled to said at least one carbon nanotube fiber.

8. A radiant heat barrier insulation system for an underwater diver, comprising:

a first flexible substrate comprised of a carbon nanotube fiber sheet and having an inner and outer side;

a first layer of aluminum on said outer side of said first substrate;

a second flexible substrate comprised of a hydrophobic fabric and having an inner and outer side, said second substrate positioned so that said inner side of said second substrate opposes said inner side of said first substrate, forming a gap therebetween;

a second layer of aluminum on said outer side of said second substrate; and a randomly-oriented nest of carbon nanotube fibers disposed within said gap.

9. A radiant heat barrier insulation system as in claim 8, further comprising:

a plurality of carbon nanotube fibers coupled to one of said first substrate and said second substrate adjacent to said gap; and a DC current source coupled to said plurality of carbon nanotube fibers.

10. A radiant heat barrier insulation system as in claim 8, further comprising:

a plurality of carbon nanotube fibers coupled to said first layer of aluminum; and a DC current source coupled to said plurality of carbon nanotube fibers.

* * * * *